US005140895A

United States Patent [19]

Imanishi

[11] Patent Number: 5,140,895

[45] Date of Patent: Aug. 25, 1992

[54] VALVE MECHANISM FOR CONTROLLING A PRESSURE DIFFERENCE BETWEEN AN UPPER AND A LOWER CHAMBER OF A HYDRAULIC CYLINDER FOR A DIE CUSHION FOR A PRESS

[75] Inventor: Shozo Imanishi, Sagamihara, Japan

[73] Assignee: Aida Engineering Co., Ltd., Sagamihara, Japan

[21] Appl. No.: 592,371

[22] Filed: Oct. 3, 1990

[30] Foreign Application Priority Data

Oct. 18, 1989 [JP] Japan ..... 1-271248

[51] Int. Cl.[5] ..... F15B 13/16

[52] U.S. Cl. ..... 91/361; 91/417 R; 91/437; 91/440; 72/453.15; 100/269 R

[58] Field of Search ..... 91/23, 321, 361, 399, 91/417 R, 437, 440, 459, 449; 60/468, 368, 494; 72/453.15; 100/269 R

[56] References Cited

U.S. PATENT DOCUMENTS

| | | | |
|---|---|---|---|
| 1,408,608 | 3/1922 | Kreyer | 91/399 |
| 2,984,980 | 5/1961 | Rowles et al. | 60/461 |
| 3,574,999 | 4/1971 | Nectoux | 60/494 |
| 4,282,798 | 8/1981 | Barlow et al. | 91/437 |
| 4,382,360 | 5/1983 | Dummer | 60/468 |
| 4,396,215 | 8/1983 | McCutcheon | 91/437 |
| 4,520,626 | 6/1985 | Nokajima et al. | 60/468 |
| 4,796,428 | 1/1989 | Hall | 91/417 R |

FOREIGN PATENT DOCUMENTS

| | | | |
|---|---|---|---|
| 798748 | 7/1958 | United Kingdom | 91/417 |

OTHER PUBLICATIONS

Pippenger, et al, Industrial Hydraulics, copyrighted 1979.

*Primary Examiner*—Edward K. Look
*Assistant Examiner*—F. Daniel Lopez
*Attorney, Agent, or Firm*—Spencer, Frank & Schneider

[57] ABSTRACT

A double acting hydraulic cylinder is a die cushion for a press, with an upper and a lower chamber in communication with each other and with a differential pressure between the two chambers automatically controlled by a valve mechanism. With the differential pressure controlled according to one of several desired curves, the die cushion capability during press operation can be changed and adjusted to a valve suitable for the product to be processed and so a wide variety of products can be produced in high quality and high efficiency.

21 Claims, 4 Drawing Sheets

VALVE MECHANISM FOR CONTROLLING A PRESSURE DIFFERENCE BETWEEN AN UPPER AND A LOWER CHAMBER OF A HYDRAULIC CYLINDER FOR A DIE CUSHION FOR A PRESS

BACKGROUND OF THE INVENTION

1. Prior art

A conventional type die cushion apparatus is shown in FIG. 5. A piston 102 is incorporated in an air cylinder 101 so that it can freely go up and down, and a wear plate 104 is fixed on an upper portion of a piston rod 103. The wear plate 104 receives the lower surface of a cushion pin (not shown), which is inserted into female mold, and the blank holder pressure is transmitted to the cushion pin by the air cylinder 101 and the piston 102. An upper chamber 101U and a lower chamber 101L are formed by air cylinder 101 and piston 102, and the upper chamber 101U communicates with atmospheric air through an opening 105. The lower chamber 101L communicates with an air tank 106 through a connection pipe 107. The air tank 106 is connected to an air supply circuit 108, and compressed air of a predetermined pressure is supplied.

When press operation (e.g. drawing) is performed by this die cushion equipment, the compressed air corresponding to the blank holder pressure required is supplied to the air tank 106.

The compressed air with lower chamber pressure PL satisfying the condition:

Blank holder force F = (Effective pressed area Al of piston 102) × (Pressure in lower chamber PL)

is supplied. As the slide of the press goes down, the piston 102 goes down through cushion pin, wear plate, etc., a blank holder force is generated. When the piston 102 comes to the lower limit (at the lowest position), the drawing process is completed. Then, the slide of the press goes up, and wear plate 104, piston 102, etc. also go up. (Problems to be solved by the invention)

In the above die cushion equipment of conventional type, it is discussed here how the blank holder force is changed when the piston 102 goes down. FIG. 4 shows the operation of the apparatus according to this invention and that of the conventional type equipment. The stroke of the piston 102 is given on the abscissa, and the blank holder force is shown on the ordinate. Namely, the abscissa shows the position when the piston 102 moves from the upper limit w (the highest position) to the lower limit LL, and the ordinate give the blank holder force generated by the piston 102 (such as F, Fa, Fae, etc.).

When it is supposed that the necessary blank holder force is Fa, the blank holder force is Fae when the piston 102 reaches the lower limit. The blank holder force at the lower limit is increased by Fae-Fa compared with the value at the upper limit because the capacity of the lower chamber 101L is decreased as the piston 102 goes down.

It is not desirable that the blank holder increases in the drawing process. Therefore, an air tank with large capacity air tank 106 is furnished in the past. The capacity should be as large as possible. It is about 5–8 times as high as that of the air cylinder 101 in a normal case because of limits on the space available for installation. Accordingly, there have been the following problems with the die cushion equipment of the conventional type:

(1) A large capacity air tank 106 is required, and it is not very easy to keep the space of installation.

Especially, a serious problem arises in a case of a transfer press because a large number of die cushion apparatus are to be installed.

(2) Even when the large capacity air tank 106 is furnished, it is impossible to reduce the increase of the blank holder force to zero.

(3) Air pressure in the air tank 106 must be adjusted when a die is replaced. This requires a long time because of the large capacity. When it is adjusted by decreasing the air pressure, compressed air must be discharged and this is not very economical. (4) When the blank holder force is to be increased or decreased as the piston 102 goes down in the drawing process, it cannot be freely increased or decreased.

SUMMARY OF THE INVENTION

The object of the present invention is to offer a small and compact die cushion apparatus for a press, which is easy to handle and can be produced at low cost and which can maintain the die cushion capability at a constant level and can change the settings during operation. Thus, the disadvantages of conventional equipment which requires large capacity buffer tank, large size compressor and quick-acting large size exhaust valve, etc. because an air cylinder system is adopted can be eliminated.

To solve these problems, the apparatus according to the present invention consists of a closed type cylinder unit, which is to replace the open-to-atmosphere type cylinder of the conventional equipment. The new equipment is also based on the principle that a die cushion capability obtained by the closed type cylinder is determined by the differential pressure between the lower chamber pressure and the upper chamber pressure, and the differential pressure is controlled by providing communication between the lower and upper chamber.

Specifically, the equipment according to the present invention comprises:

a first control valve furnished in a first oil passage which provides communication between the lower chamber and the upper chamber on opposite sides of the piston of hydraulic cylinder when the piston is moving downward, a second control valve furnished in a second oil passage, which provides communication between the lower chamber and the upper chamber when the piston is moving upward, a hydraulic pressure supply means, fluidly connected to the first oil passage between the lower chamber and the first control valve through a check valve, for supplying hydraulic pressure to the lower chamber, a buffer oil tank, fluidly connected to the first oil passage between the lower chamber and the first control valve, for accommodating a part of the oil in the lower chamber when piston goes down, a control means for controlling the first control valve when the differential pressure between the lower chamber pressure and the upper chamber pressure, changing when the piston does down exceeds a preset differential value, and a second control means for controlling the second control valve to hinder an increase of the upper chamber pressure when the piston goes up.

Therefore, the preset hydraulic pressure is to be established in the lower chamber of the hydraulic cylinder by hydraulic pressure supply means according to this invention. When the piston goes down from the upper limit due to the press load, the lower chamber pressure is increased, and the differential pressure between the lower chamber pressure and the upper chamber pressure is rapidly increased. Thus, the die cushion capability corresponding to the preset hydraulic pressure value is established.

Further, when the piston goes down, the differential pressure between two chambers exceeds the preset differential pressure value. Then, the first control valve is opened by the first control means, and the lower chamber communicates with the upper chamber. Consequently, the lower chamber pressure is decreased, and the first control valve is closed.

Next, the first control valve is controlled when the piston goes down, and the differential pressure between two chambers is controlled to the preset differential pressure as set by the first control means.

Therefore, if the preset differential pressure is determined according to piston stroke to gradual increase, gradual decrease, etc., the die cushion capability can be changed and adjusted even during the press operation. If the preset differential pressure is set at a constant level, the die cushion capability can be set equal to the constant value for all strokes.

Quantitative imbalance corresponding to the volume of the piston rod occurs between the hydraulic fluid or oil quantity discharged from the lower chamber and the quantity supplied to the upper chamber when the piston goes down, but this is absorbed by the buffer oil tank.

On the other hand, when the slide goes up, the piston goes up from the lower limit to the upper limit by the differential pressure between the two chambers. Then, the pressure in the upper chamber gradually increases, and when the pressures in both chambers are approximately equal to each other, the shut-off valve is opened, so that the upper lower chambers communicate with each other. As a result, an excessive increase of the upper chamber pressure is hindered, and the pressures in both chambers become equal to each other.

Under such conditions, the piston is pushed upward by the difference of the effective area due to the presence of the piston rod (sectional area), and the piston goes up relatively slowly.

Because residual pressure exists within the upper chamber, the piston goes up to the upper limit without generating a big impact force.

By taking the proper timing to close the second control valve, it is possible to extensively increase the upper limit damper effect.

Therefore, it is possible according to the present invention to eliminate the large buffer air tank, high pressure large capacity compressor, quick-acting large size exhaust valve, etc. in the conventional type air cylinder apparatus and to establish the die cushion capability accurately and quickly with compact and lightweight equipment at a low operating cost.

In the figures, 1 refers to a hydraulic cylinder, 1U an upper chamber, 1L a lower chamber, 2 a piston, 10 a first oil passage, 11 (A, B and C) pipes, 13 a buffer oil tank, 14 hydraulic pressure supply means, 17 a check valve, 20 a first control valve, 21 a main unit, 28 an air pressure regulating valve, 30 a second oil passage, 40 a second control valve, 50 first control means, 51 a control unit, 52 capability signal generating means (capability signal generator), 53 capability memorizing means (capability diagram storage), 54 selection means (selector), 55 a standard capability setter, 57 a pressure detector, 60 second control means, 61 a controller, 62 a pressure setter, 65 a pressure detector, and 70 a control panel.

DESCRIPTION OF THE PREFERRED EMBODIMENTS

In the following, the embodiments of the present invention will be described in connection with the drawings.

First Embodiment

Figure 1:
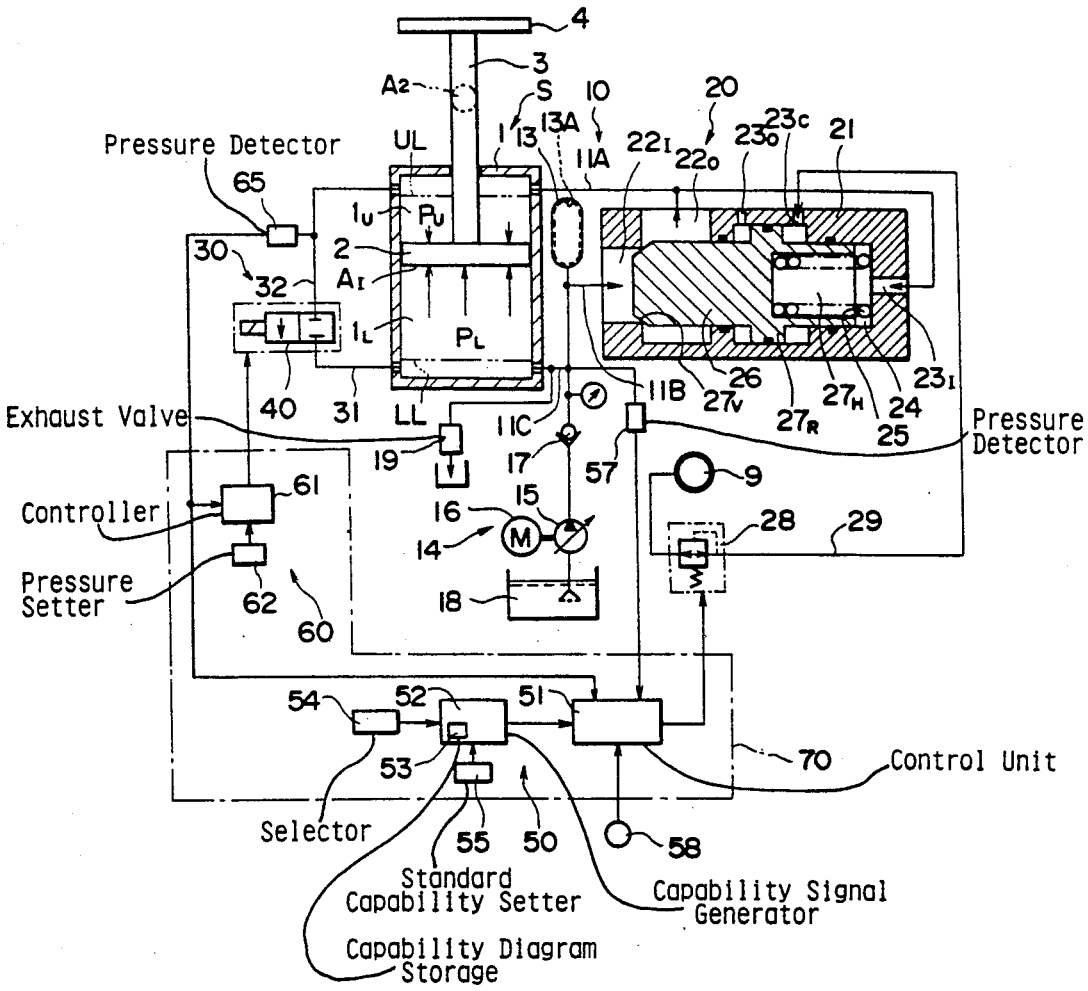
FIG. 1 is a general schematical diagram of a first embodiment of this invention.

As shown in FIG. 1, the first embodiment comprises hydraulic cylinder units (1, 2), a first control valve 20, a second control valve 40, hydraulic pressure supply means 14, a buffer oil tank 13, a first control means 50, a second control means, etc. and it is designed in such manner that the die cushion capability can be changed or adjusted or maintained at a constant level during the press operation.

Figure 5:
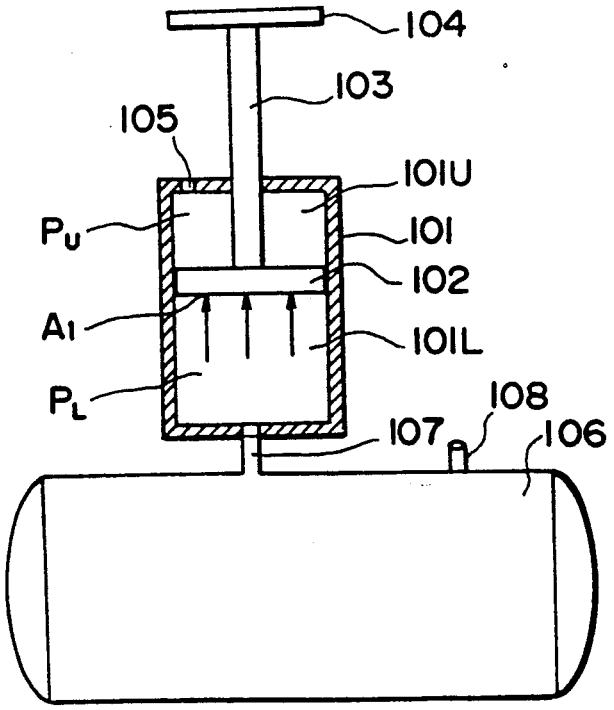
FIG. 5 PRIOR ART
FIG. 5 is a general schematical drawing of a die cushion apparatus of a conventional air cylinder type.

First, the hydraulic cylinder units are of a closed type, consisting of a hydraulic cylinder 1 (upper chamber 1U and lower chamber 1L), a piston 2 and a piston rod 3 (connected to a wear plate 4). Specifically, the basic structure is the same as the air cylinder units (101, 102, 103 and 104) as shown in FIG. 5. According to the present invention, it is designed as a hydraulic pressure type and can be used at high pressure. This leads to the compact design and high responsiveness.

The lower chamber 1L and the upper chamber 1U having a piston 2 of the hydraulic cylinder 1 between them communicate with each other by a first oil passage 10 (pipes 11A–11C) and a second oil passage 30 (pipes 31 and 32). The first oil passage 10 is provided with a first control valve 20, and the second oil passage 30 with a second control valve 40.

A hydraulic pressure supply means 14 (pump 15 and motor 16) for supplying the preset hydraulic pressure is furnished to the first oil passage 10 between the lower chamber 1L and the first control valve 20 through a check valve 17. The means 14 is to set hydraulic pressure in the lower chamber 1L in the so-called initial state (with the piston 2 at the upper limit UL).

An oil tank 18 provides the oil for the pressure supply means 14, and an exhaust oil valve 19 is provided to move the cushion downward.

Further, a buffer oil tank 13 is connected between the lower chamber 1L of the first oil passage 10 and the first control valve 20, and it is to accommodate a part of oil flowing out of the lower chamber 1L when the piston 2 goes down. In other words, when the piston 2 goes down, the oil in the lower chamber 1L is supplied to the upper chamber 1U through the first control valve 20. In this case, the change in actual volume of the upper chamber 1U is smaller than the change in the volume of the lower chamber IL by the change in the volume with the cylinder 1 taken up by piston rod 3, which is inserted into the oil cylinder 1. In this connection, the buffer oil tank 13 is furnished to temporarily accommodate the volume difference. In the present embodiment, it is formed as an accumulator having the capacity to receive the oil with the volume equal to the volume difference when the piston 2 goes down to the lower limit LL. Therefore, a buffer 13A with sealed-in nitrogen gas is incorporated in this buffer oil tank 13, and it accommodates the oil when the pressure exceeds the preset oil pressure.

Here, the first control valve 20 consists of a main unit 21 in a hollow cylindrical shape and of a cylindrical valve disc (spool) 26 slidably inserted into this main unit 21. It has the structure of a check valve permanently closed.

On the front end of the main unit 21, an oil inlet 22I and an oil outlet 22O to be connected with the pipe 11B are furnished. On the rear end of the main unit, an inlet 23I to apply the upper chamber pressure PU is provided through the pipe 11A.

On the other hand, a spring 25 is mounted in the hollow portion 27H at the rear end of the valve disc 26, and a valve unit 27V is furnished on the front end to close the oil inlet 22I.

Accordingly, when the lower chamber pressure PL is increased, valve disc 26 is moved toward the right in FIG. 1 against the force of the spring 25, and the lower chamber 1L and the upper chamber 1U of the hydraulic cylinder 1 communicate with each other through the oil inlet 22I and the outlet 22O.

When oil is released from the lower chamber 1L, the lower chamber pressure PL is decreased, and the first control valve 20 is again blocked by the force of the spring 25.

In this case, the cracking pressure of the first control valve 20 functioning as a check valve is primarily determined by the force of the spring 25.

The features of the first control valve 20 according to the present invention is that cracking pressure is variable. Thus, pressurized air (or oil pressure) is supplied from the air inlet 23C at the intermediate portion of the main unit 21. The pressurized air as control signal further increases the cracking pressure in addition to the force of the spring 25. In other words, minimum cracking pressure is established by the force of the spring 25, and a cracking pressure higher than this is determined by the air pressure (or oil pressure) supplied to the inlet 23C. Oil outlet 22O and oil inlet 23I are communicated with each other for the power balance of the valve disc 26. Reference number 23O designates an opening to atmospheric air.

The first control means 50 is a means to set the cracking pressure of the first control valve 20, i.e. a control means to open or close the first control valve 20 when the differential pressure between the pressure PU in the lower chamber 1L and the pressure PL in the upper chamber 1U, changing with the downward movement of the piston 3, exceeds the preset differential pressure. In the present embodiment, it is to set the air pressure (or oil pressure) to supply to the inlet 23C of the first control valve 20. Namely, the first control means 50 consists of a control unit 51 and a pressure regulating valve 28 serving as an electric converter and mounted on the pipe 29, which connects the inlet 23C of the first control valve 20 with the air source (or oil source). Control unit 51 and other associated elements are stored in the control panel 70 together with the controller 61 and other elements.

The control unit 51 in this embodiment issues electric signals to control the pressure regulating valve 28 in order to equalize the differential pressure, obtained through comparative calculation from lower chamber pressure PL and upper chamber pressure PU, to the differential pressure corresponding to the capability signal, using the lower chamber pressure PL from pressure detector 57, the upper chamber pressure PU from pressure detector 65 and the crackshaft angle from angle detector 58 as input factors. In other words, it is to closed loop control the cracking pressure of the first control valve 20.

A capability signal representing a desired die cushion capability equal to the next upward hydraulic force applied to the piston as a result of the pressures PU and PL in the chambers 1U and 1L, may be formed to be memorized in the control unit 51 itself. In this embodiment, it is outputted from the capability signal generating means 52.

The capability signal generating means 52 specifies the die cushion capability to obtain the blank holder pressure necessary for press operation in relation to the stroke of the piston 2, and it comprises a capability memorizing means 53 to memorize (store) a plurality of capability diagrams, i.e. die cushion capability-piston stroke curves.

Figure 4:
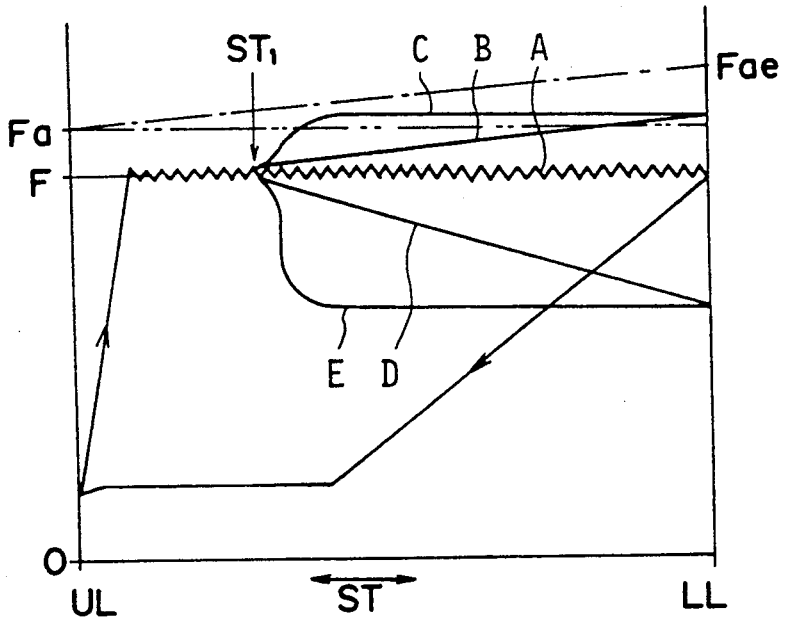
FIG. 4 is a diagram to explain the operation of the embodiments in comparison with the operation of conventional die cushion equipment.

A capability diagram is a diagram of the curves B–E as shown in FIG. 4, and the capability is changed during the change of piston position, i.e. during press operation. For wider usability, the curve A with constant capability is also memorized.

The selection means 54 selects the curve from the capability diagram.

Further, the capability signal generating means 52 in the first embodiment is designed in such a manner that it can generate the capability signal, rapidly rising up to a standard capability F as set by the standard capability setter 55 up to the piston position ST1 in FIG. 4.

It goes without saying that the diagram for the range from the upper limit UL to the lower limit LL or from the lower limit LL to the upper limit UL may be memorized (stored) by the capability signal generating means 52 and the capability signal corresponding to the diagram selected by the selection means 54 may be outputted to the control unit 51. In that case, the standard capability setter 55 may be omitted.

The movement of the piston which is in coordination with a crank shaft not shown, is specified by the rotational angle of the crankshaft inputted from an angle detector 58. Also, because the capability memorizing means 53 is formed from a reloadable ROM, the capability diagram can be changed, added or deleted as appropriate.

The second oil passage 30 provides communication between the upper chamber 1U and the lower chamber 1L with proper timing when the piston 2 is going up, and it consists of pipes 31 and 32, which connect the two chambers 1U and IL. The second control valve 40 is composed of an electromagnetic valve or a servovalve, which is installed in the pipes 31 and 32.

The second control means 60 to control the second control valve 40 comprises a pressure setter 61 and a controller 62, and the controller 62 compares the upper chamber pressure PU detected by the pressure detector 65 and the preset value of the pressure setter 61 and issues the signal to excite solenoid during upward movement of the piston 2 when these two values are equalized to each other. When the solenoid is excited, the second control valve 40 is opened. The controller 62 turn off the signals and closes the second control valve 40 again when the piston 2 moves most closely to the upper limit UL.

In the first embodiment with the above arrangement, the operation is performed as follows:

First, the initial pressure in the lower chamber 1L is set by the hydraulic pressure supply means 14. Then, the standard capability F to be established up to the piston position ST1 is set by the standard capability setter 55, and the capability from the stroke ST1 and after is selected from the curve suitable for the desired product type (e.g. the curve E of FIG. 4) by the selection means 54. Also, the upper chamber pressure PU to close the second control valve 40 is set by the pressure setter 62.

In FIG. 4, the curves B to E are drawn by simplified expression to the curve A (average capability is shown), and the data for the upward movement of piston are not given in the diagram because they are easily imaginable from the curve (1).

The die cushion capability F is determined by the following equation:

$$F = PL \cdot A1 - PU \cdot (A1 - A2)$$

Because the upper chamber 1U is opened to the atmospheric air in the conventional air cylinder types as given in FIG. 5, the predetermined capability Fa is established as soon as the piston rod 103 is displaced downward. Then, the die cushion capability gradually increases up to Fae at the lower limit LL as shown by dashed line in FIG. 4. Because the volume of the buffer air tank 106 is larger by 5–8 times, it is impossible to maintain the necessary die cushion capability Fa at a constant level. At the lower limit LL, the blank holder pressure becomes excessive by 20–25%.

According to the present invention, when the piston 2 moves downward from the upper limit UL, the lower chamber pressure PL is raised, and the differential pressure from the upper chamber pressure PU is increased, and the standard capability F can be quickly generated. The higher the initial pressure to the lower chamber 1L is, the earlier this rise-up occurs.

When the piston 2 continues to go down after the standard capability F is established, the control unit 51, constituting the first control means 50, controls the pressure regulating valve 28 so that the differential pressure obtained from the input from the pressure detectors 57 and 65 becomes equal to the differential value corresponding to the capability signal output from the capability signal generating means 52. As a result, the cracking pressure is regulated, and the first control valve 20 is opened by this cracking pressure. The excess oil is received by the buffer oil tank 13. Then, the lower chamber 1L communicates with the upper chamber 1U, the lower chamber pressure PL decreases and the first control valve 20 is closed again.

Therefore, the differential pressure is changed, repeating small fluctuations within the allowable range of necessary blank holder pressure. Thus, the standard capability F can be substantially maintained at a constant level up to the stroke ST1.

Here, if the curve A in FIG. 4 is selected by the selection means 54, the capability signal generating means 52 reads out said curve A from the diagram memorized by the capability memorizing means 53 and outputs it to the control unit 51. In this case, the first control valve 20 is controlled by the first control means (51, 28, etc.) to maintain the capability F at constant level until the piston 2 reaches the lower limit LL.

When the curve E is selected, for example, the control unit 51 controls the pressure regulating valve 28 to change the die cushion capability according to the curve E based on the input from the capability signal generating means 52, the input from two pressure detectors 57 and 65, and the input from the angle detector 58, and it controls the first control valve 20. The die cushion capability is decreased stepwise after the piston stroke during the press operation passes ST1, and it is maintained at a constant level until the stroke reaches the lower limit LL.

In case of the curve (4), it is gradually decreased. It is increased stepwise in the case of the curve C and is gradually increased in the case of the curve B.

On the other hand, the upward movement of the piston 2 from the lower limit LL complies with the upward movement of the slide in the initial stage according to the differential pressure between two chamber pressures PL and PU, and it is smoothly performed thereafter in a no-load state. Because the lower chamber pressure PL becomes lower and the upper chamber pressure PU becomes higher, the differential pressure is rapidly decreased.

When the upper chamber pressure PU exceeds the preset value set by the pressure setter 62, the second control valve 40 is opened by the signal from the controller 61, and the two chambers 1U and 1L communicate with each other. Accordingly, the pressure values in two chambers PL and PU are equalized to each other. The piston 2 goes up further by the pushing force generated by the difference of effective area due to the presence and absence of cross-sectional area A2 of the piston rod 3 on the respective opposite sides of the piston.

This may be left to reach the upper limit UL. In the present embodiment, the second control valve 40 is blocked again immediately before the upper limit UL. Because the upper chamber pressure PU is slightly increased, and the pushing force of the piston 2 is rapidly decreased, the damping effect at the upper limit UL can be extensively increased.

When the piston 2 moves most closely to the upper limit UL, it is effective to open and close the first control valve 20 momentarily again.

According to this embodiment, a first oil passage 10 and a second oil passage 30 are provided to permit the upper chamber 1U and the lower chamber 1L of hydraulic cylinder 1 to communicate with each other. When the piston goes down, the first control valve 20 is controlled by the first control means 50 in order to control the differential pressure between the lower chamber pressure PL and the upper chamber pressure PU, and the desired die cushion capability can be established. Through the control of the second control valve 40 by the second control means 60 with proper timing during upward movement, adequate cushion damper is obtained by hindering the increase of the upper chamber pressure PU. Thus, there is no need to provide an extra-large buffer air tank 106 or a large size compressor as is required in the case of the conventional air cylinder type equipment. The space for installation is also small and economical. Because cylinder units (1, 2) are of the hydraulic pressure type, each of the equipment components can be designed in a compact form, and high responsiveness can be provided by increasing hydraulic pressure.

The first control valve furnished in the first oil passage 10 has the function of a check valve, and the setting of the cracking pressure can be changed by the first control means 50 (51, 28, etc.), and it is very easy to set the die cushion capability. Moreover, initial idle twisting is reduced because it is of a hydraulic pressure type, and the equipment is operated smoothly regardless of the volume of the upper chamber 1U of the cylinder 2.

The first control means 50 is specified by the selection means 54 and capability memorizing means 53, and the first control valve 20 is controlled by differential pressure according to the capability signal issued from the capability generating means 52. Thus, the die cushion capability can be changed and adjusted according to the predetermined curve. Since die cushion capability can be changed during a press operation, a wide variety of products can be produced with high quality and with high efficiency. The material costs can also be reduced, and there are no inconveniences such as restrictions on the form of materials. Quick start-up and stopping adjustment can be accomplished.

Also, the hydraulic cylinder units (1, 2) are designed in closed type and the first oil passage 10 and the second oil passage 30 are controlled by a die cushion capability to cause the two chambers 1U and 1L to communicate with or to be isolated from each other. Accordingly, a high pressure large capacity compressor or a quick-acting large size exhaust valve can be omitted, and the equipment is compact and economical. Because the adjustment of the die cushion capability can be achieved simply by changing the setting of cracking pressure of the first control valve 20, it can be performed rapidly and accurately. Thus, the waiting time is shorter, and the press production efficiency can be increased. Moreover, there is no need to release oil during the adjustment of the die cushion because a buffer oil tank 13 is furnished. Therefore, the disadvantages caused by release of the air in large quantity as seen in case of the conventional equipment can be eliminated, and operating economy is assured.

In the first control valve 20, the basic die cushion capability is restricted by the pushing force of the spring 25, and the cracking pressure is set by changing the air pressure to the air inlet 23C through the balance system, in which the upper chamber pressure PU is applied to oil outlet 22-0 and inlet 23-I. Thus, it is possible to reduce the size of hydraulic cylinder units (1, 2) by increasing the preset pressure of the oil in the lower chamber 1L, and smooth control can be accomplished by decreasing the control air pressure.

Further, it is possible to leave the upper chamber pressure PU near the upper limit UL of the piston. Namely, the differential pressure can be reduced by taking proper timing to block the second control valve 40, and the impact at the upper limit UL can be extensively decreased.

Second Embodiment

Figure 2:
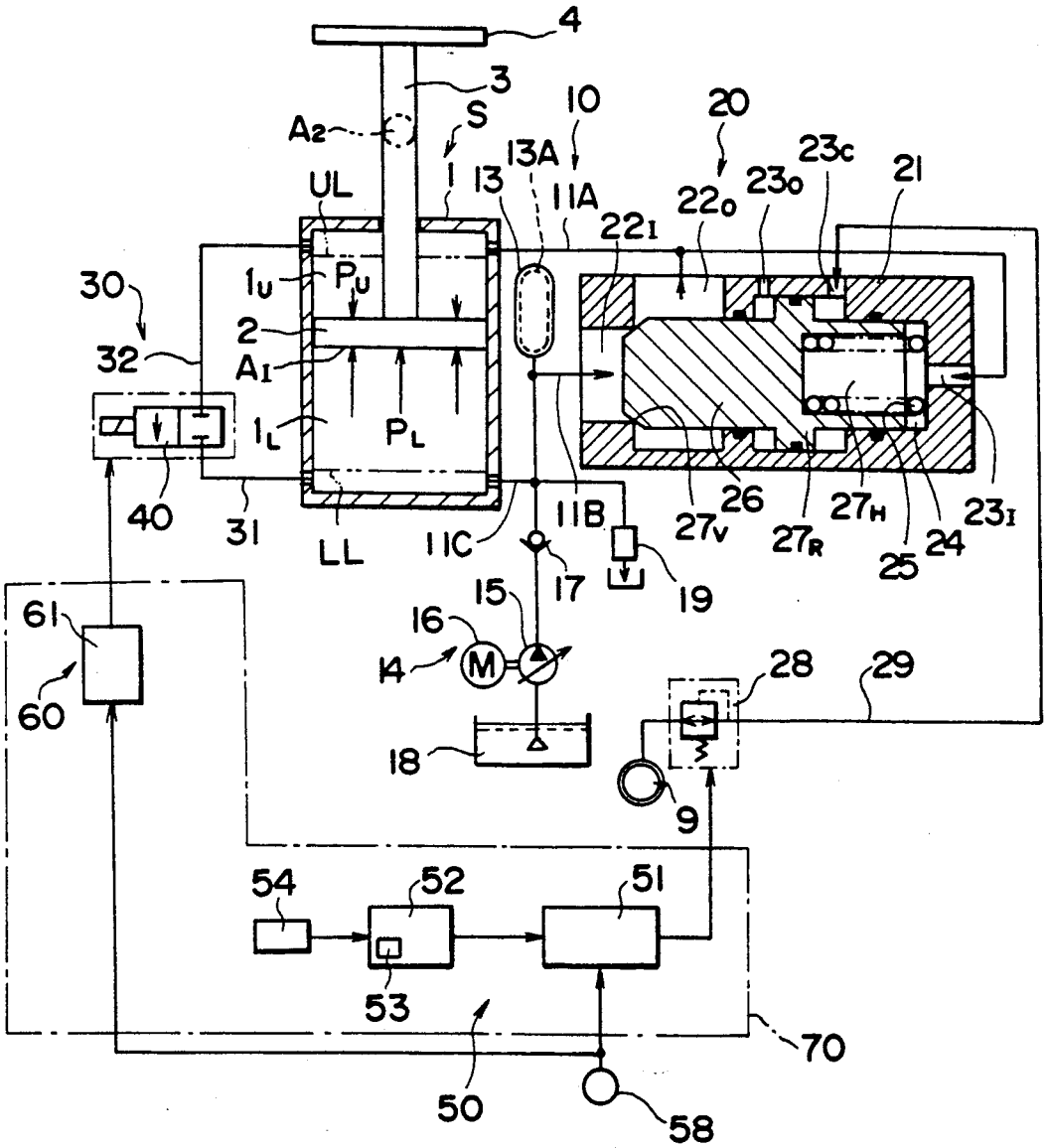
FIG. 2 is a general schematical diagram of a second embodiment of the invention.

FIG. 2 shows the second embodiment of this invention.

In the second embodiment, the equipment facilities are more simplified than in the first embodiment.

Specifically, when the form and the characteristics of hydraulic cylinder units (1, 2), the first control valve 20 and the second control valve 40 are defined, the lower chamber pressure PL and the upper chamber pressure PU during the upward and downward movement of the piston 2, the differential pressure between the pressure values PL and PU, and the relation between upward or downward movements of the slide and the blank holder pressure required are all made clear if press arrangement and the products to be processed are specified. Therefore, the first control valve 20 is controlled by differential pressure, whereas the pressure values in two chambers and the differential pressure are not detected, and these are replaced by the crankshaft angle.

Accordingly, the pressure detectors 57 and 65 required in the first embodiment are not included in this arrangement.

Also, the standard capability setter 55 is not provided, and the die cushion capability for all strokes from the upper limit UL to the lower limit LL of the piston 2 is memorized by the capability memorizing means 53. Thus, the control unit 51 to form the first control means 50 specifies the capability signal input from the capability signal generating means 52 by the crankshaft angle from the angle detector 58, controls the pressure regulating valve 28 and sets the cracking pressure of the first control valve 20. That is, the first embodiment is designed in closed loop, while the second embodiment forms an open loop having a curve read from the capability memorizing means 53 as a preset differential pressure value.

Further, the second control means 60 to control the second control valve 40 is constituted only from the controller 61, which is a program sequence. In the upward movement of the piston 2, the second control valve 40 is controlled depending upon the crankshaft angle according to the predetermined procedure. However, opening and closing of the valve is controlled in the same timing as in the first embodiment. The setting of the opening and closing procedure and the timing can be changed.

Also, in the case of the second embodiment, the same effects as in the first embodiment can be obtained (such as the elimination of a conventional type large size buffer tank, a high pressure large capacity compressor and a quick-acting large size exhaust valve, change and adjustment of die cushion capability), during press operation) by using the crankshaft angle as an input.

Moreover, simpler structure and low cost can be achieved compared with the case of the first embodiment through elimination of two pressure detectors (57 and 65) and the simplification of the first control means 50.

Each operation is not defined directly by the differential pressure between the pressure values PL and PU in two chambers rather it is defined by crankshaft angle and only indirectly by values PL and PU. If the capability diagram to be memorized by the capability memorizing means 53 is clearly defined, automatic adjustment of die cushion capability during press operation can be freely and easily achieved.

Third Embodiment

Figure 3:
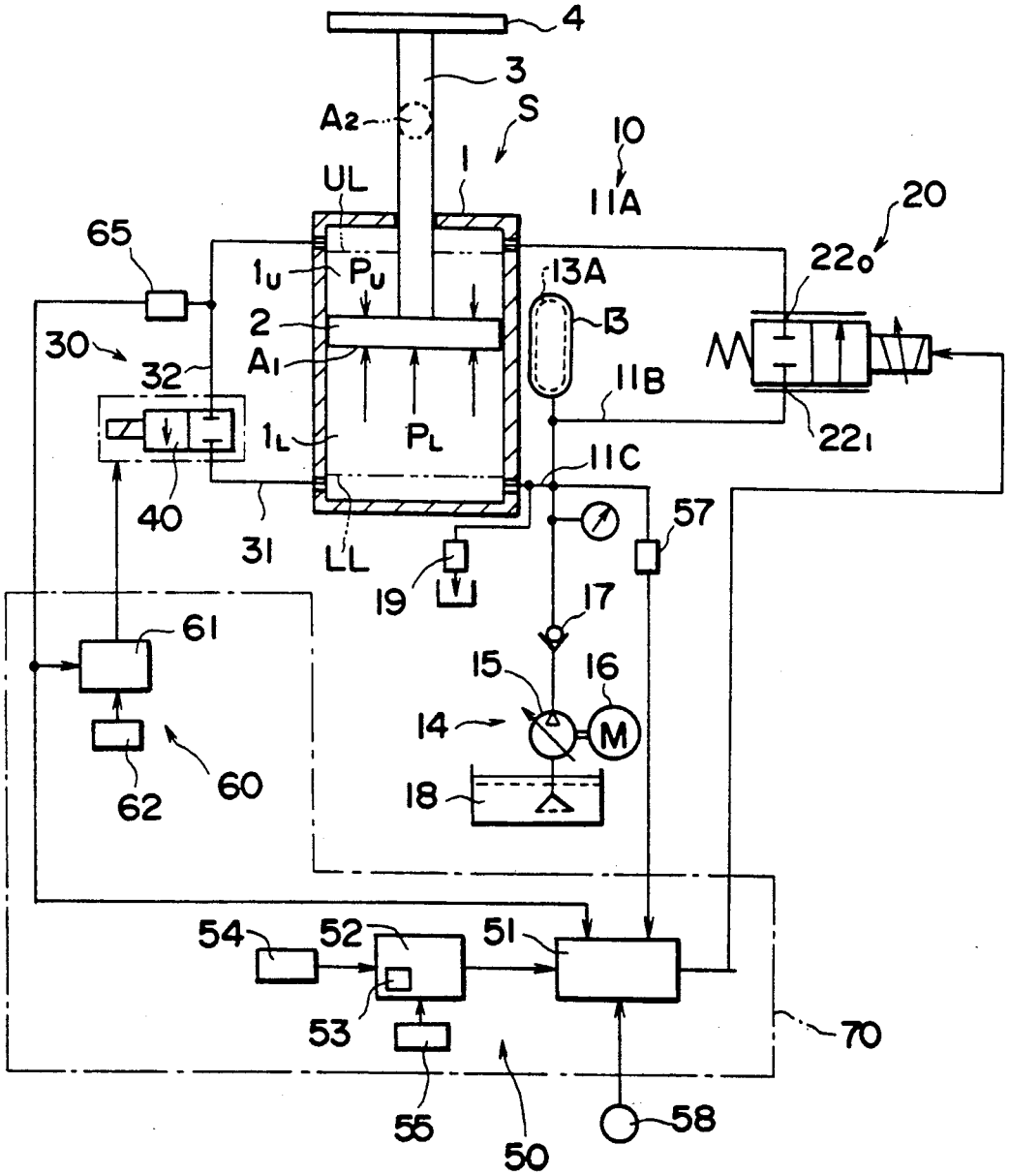
FIG. 3 is a general schematical diagram of a third embodiment of the invention.

The third embodiment is given in FIG. 3. In this embodiment, hydraulic cylinder units (1, 2), buffer oil tank 13, hydraulic pressure supply unit 14, the first control means 50, the second control valve 40, and the second control means 60 are the same as in the first embodiment. The first control valve 20 consists of a servo valve directly controlled by differential pressure through electric signals. Thus, pneumatic equipment and devices (9, 28, 29) are eliminated to simplify the facilities.

The same effects as in the first embodiment can be obtained in this third embodiment, and the responsiveness is extensively increased because there is no need of electro-pneumatic conversion.

In the above embodiments, the control unit 51, the capability signal generating means 52, the capability memorizing means 53, the controller 61, etc. are furnished separately, whereas these components may be organically integrated by computer or other devices including a CPU, a RAM, a ROM, etc.

What is claimed is:

1. A die cushion apparatus for a press, comprising:

a first control valve furnished in a first oil passage which provides communication between a lower chamber and an upper chamber on opposite sides of a piston in an oil filled hydraulic cylinder, a second control valve furnished in a second oil passage which provides communication between the lower chamber and the upper chamber, a hydraulic pressure supply means, connected through a check valve to the first oil passage between the lower chamber and the first control valve, for maintaining a preset minimum oil pressure in the lower chamber during upward and downward movement of the piston, a buffer oil tank connected to the first oil passage between the lower chamber and the first control valve and accommodating a part of the oil in the lower chamber when the piston goes down, a first control means to open or close the first control valve when a differential pressure between the lower chamber pressure and the upper chamber pressure, changing when the piston goes down, exceeds a preset differential value, and a second control means to open or close the second control valve to hinder an increase of the upper chamber pressure when the piston goes up.

2. A die cushion apparatus according to claim 1, wherein said first control valve comprises a hollow cylindrical main unit having an inlet communicating through said first passage with the lower chamber and an outlet communicating through said first passage with the upper chamber, a valve spool slideably engaged in said main unit, and means for elastically urging said valve spool with a predetermined force toward a first position to close said inlet, said predetermined force determining a minimum cracking pressure, said first control means including means for applying fluid pressure to said valve spool to obtain a cracking pressure higher than said minimum cracking pressure.

3. A die cushion apparatus according to claim 2, wherein said first control means comprises a pressure regulating valve, a control unit and a capability signal generating means for generating and inputting to said control unit a die cushion capability signal, the die cushion capability signal corresponding to the preset differential value, and said control unit is responsive to said die cushion capability signal to an electric signal for controlling opening of said pressure regulating valve so that the differential pressure between the lower chamber pressure and the upper chamber pressure of the hydraulic cylinder is equalized to the preset differential value.

4. A die cushion apparatus according to claim 3, wherein said capability signal generating means comprises means for storing a plurality of capability diagrams, each diagram representing a possible correspondence between the preset differential value and the position of said piston during its downward movement in the hydraulic cylinder, and a selection means for selecting one of said capability diagrams, said capability signal generating means generating the capability signal based on the capability diagram selected by said selection means.

5. A die cushion apparatus according to claim 4, wherein the piston reciprocates between an upper position and a lower position and the correspondence between the preset differential value and the position of the piston of each capability diagram is defined with respect to the position of the piston from a specified position to the lower position, the first control means further comprising a standard capability setter which sets a standard capability value and inputs the standard capability value to the capability signal generating means, the standard capability value representing a standard hydraulic pressure differential, to be attained in the hydraulic cylinder during a downward movement of the piston from the upper position to the specified position, and to be maintained until the piston reaches the specified position, and wherein upon an initiation of a downward movement of the piston from the upper position, the capability signal generating means, in response to a signal indicative of the position of the piston and in response to receipt of the standard capability value, issues a capability signal which rises rapidly to the standard capability value and is maintained at said standard capability value until the piston reaches the specified position.

6. A die cushion apparatus according to claim 1, wherein said first control means further comprises a control unit, and a capability signal generating means for generating and inputting to said control unit a die cushion capability signal, the die cushion capability signal corresponding to the preset differential value, and said control unit is responsive to said die cushion capability signal to issue an electric signal for controlling opening and closing of said first value so that the differential between the lower chamber pressure and the upper chamber pressure is equalized to the preset differential value.

7. A die cushion apparatus according to claim 6, wherein said capability signal generating means comprises means for storing a plurality of capability diagrams, each diagram representing a possible correspondence between the preset differential value and the position of said piston during its downward movement in the hydraulic cylinder, and selection means for selecting one of said capability diagrams, said capability signal generating means generating the capability signal based on the selected capability diagram.

8. A die cushion apparatus according to claim 7, wherein the position reciprocates between an upper position and a lower position and the correspondence between the preset differential value and the position of the piston of each capability diagram is defined with respect to the position of the piston from a specified position to the lower position, the first control means further comprising a standard capability setter which sets a standard capability value and inputs the standard capability value to the capability signal generating means, the standard capability value representing a standard hydraulic pressure differential, to be attained in said hydraulic cylinder during a downward movement of the piston from the upper position to the specified position, and to be maintained until the piston reaches the specified position, and wherein upon an initiation of a downward movement of the piston from the upper position, the capability signal generating means, in response to a signal indicative of the position of the piston and in response to receipt of the standard capability value, issues a capability signal which rises rapidly to the standard capability value and is maintained at said standard capability value until the piston reaches the specified position.

9. A die cushion apparatus for a press, comprising:

a hydraulic cylinder having a first end and a second end;

a piston in said cylinder, said piston dividing the interior of said cylinder into a first chamber and a second chamber, said piston being movable reciprocally between a first position adjacent said first end and a second position adjacent said second end;

a piston rod connected to said piston and extending through said first end, said piston rod receiving a force exerted by the press;

means for exerting a predetermined retarding force on said rod as said rod moves said piston from a position adjacent said first position to a position adjacent said second position, including a first passage means fluidly connecting said first and second chambers, a first control value disposed in said first passage means, means for continuously supplying a minimum hydraulic pressure to said second chamber while said piston moves reciprocally between the first position and the second position, a buffer means communicating with said first passage means between said second chamber and said first valve, a first control means, operative while said piston moves toward said second position, for repeatedly opening and closing said first valve as a function of the position of said piston relative to said first and second positions so as to control a hydraulic pressure differential in said cylinder between a hydraulic pressure in said first chamber and a hydraulic pressure in said second chamber; and means for limiting the first chamber pressure as said piston moves from said second position to said first position including second passage means fluidly connecting said first and second chambers, a second control value disposed in said second passage means, and a second control means, operative while said piston moves toward said first position, for opening said second valve so as to hinder an increase in hydraulic pressure in said first chamber.

10. A die cushion apparatus according to claim 9, further comprising means for detecting the hydraulic pressure in said first chamber while said piston moves toward said first position, said second control means opening and closing said second valve as a function of the detected hydraulic pressure in said first chamber.

11. A die cushion apparatus according to claim 9, further comprising means for detecting, and providing a signal indicative of, the position of said piston relative to said first and second positions, said first control means being responsive to said signal to open and close said first valve while said piston moves toward said second position.

12. A die cushion apparatus according to claim 11, further comprising means for detecting the hydraulic pressure differential in said cylinder, said first control means opening and closing said first valve as a function of the hydraulic pressure differential while said piston moves toward said second position.

13. A die cushion apparatus according to claim 12, further comprising means for detecting and providing a signal indicative of the position of said piston relative to said first and second positions, said second control means being responsive to said signal to open and close said second valve while said piston moves toward said first position.

14. A die cushion apparatus according to claim 9, wherein said first valve comprises a hollow cylindrical main unit having an inlet fluidly communicating with said second chamber through said first passage means and an outlet fluidly communicating said first chamber through said first passage means, a valve spool disposed in said main unit and slideable between a first spool position in which said inlet is closed and a second spool position in which said inlet is open, and means elastically urging said spool toward said first spool position with a force defining a minimum opposing cracking pressure to open said inlet; said first control means including means for applying a fluid pressure to said spool, the fluid pressure urging said spool toward said inlet, the fluid pressure determining an opposing cracking pressure higher than the minimum opposing cracking pressure.

15. A die cushion apparatus according to claim 14, wherein said fluid pressure applying means comprises a pressure regulating valve which applies the fluid pressure to said spool, said first control means further comprising means for generating a capability signal representative of a correspondence between a preset differential value and a position of said piston relative to said first and second positions; and a control unit, responsive to the capability signal and a signal indicative of the position of said piston relative to said first and second positions, for issuing a control signal, the control signal controlling said pressure regulating value to apply fluid pressure to said spool in an amount appropriate to control the hydraulic pressure differential in said cylinder to be equal to the preset differential value corresponding to the position of the piston.

16. A die cushion apparatus according to claim 15, wherein said capability signal generating means comprises means for storing a plurality of capability diagrams, each diagram representing a different possible correspondence between the preset differential value and the position of said piston as said piston moves toward said second position, said first control means further comprising means for selecting one of the capability diagrams, said capability signal generating means generating the capability signal according to the selected capability diagram and outputting the capability signal to said control unit.

17. A die cushion apparatus according to claim 16, wherein for each diagram, the correspondence between the preset differential value and the position of said piston is defined for positions of said piston between a specified position and the second position, said first control means further comprising a value setter which sets a standard capability value and inputs the standard capability value to said capability signal generating means, the standard capability value representing a standard hydraulic pressure differential, the standard differential to be attained in said cylinder during a movement of said piston from the first position to the specified position, and to be maintained until said piston reaches the specified position, and wherein upon an initiation of a movement of said position from the first position, said capability signal generating means, in response to a signal indicative of the position of said piston and in response to receipt of the standard capability value, issues a capability signal which rises rapidly to the standard capability value and is maintained at said standard capability value until said piston reaches the specified position.

18. A die cushion apparatus according to claim 14, wherein said elastically urging means comprises a spring engaging said spool.

19. A die cushion apparatus according to claim 9, wherein said first control means further comprising means for generating a capability signal representative of a correspondence between a preset differential value and a position of said piston relative to said first and second positions; and a control unit, responsive to the capability signal and a signal indicative of the position of said piston relative to said first and second positions, for issuing a control signal to open and close said first valve to control the hydraulic pressure differential in said cylinder to be equal to the preset differential value corresponding to the position of the piston.

20. A die cushion apparatus according to claim 19, wherein said capability signal generating means comprises means for storing a plurality of capability diagrams, each diagram representing a different possible correspondence between the preset differential value and the position of said piston as said piston moves toward said second position, said first control means further comprising means for selecting one of the capability diagrams, said capability signal generating means generating the capability signal according to the selected capability diagram and outputting the capability signal to said control unit.

21. A die cushion apparatus according to claim 20, wherein for each diagram, the correspondence between the preset differential value and the position of said piston is defined for positions of said piston between a specified position and the second position, said first control means further comprising a value setter which sets a standard capability value and inputs the standard capability value to said capability signal generating means, the standard capability value representing a standard hydraulic pressure differential, the standard differential to be attained in said cylinder during a movement of said piston from the first position to the specified position, and to be maintained until said piston reaches the specified position, and wherein upon an initiation of a movement of said position from the first position, said capability signal generating means, in response to a signal indicative of the position of said piston and in response to receipt of the standard capability value, issues a capability signal which rises rapidly to the standard capability value and is maintained at said standard capability value until said piston reaches the specified position.

* * * * *